US006108890A

United States Patent [19]

Opper et al.

[11] Patent Number: 6,108,890

[45] Date of Patent: Aug. 29, 2000

[54] METHOD OF REMOVING PUNCH RIVETS SET INTO A WORKPIECE

[75] Inventors: Reinhold Opper, Alten-Buseck; Dieter Mauer, Lollar, both of Germany

[73] Assignee: Emhart Inc., Newark, Del.

[21] Appl. No.: 09/099,142

[22] Filed: Jun. 18, 1998

[30] Foreign Application Priority Data

Jun. 19, 1997 [DE] Germany ..... 197 26 104

[51] Int. Cl.[7] ..... B32P 19/00

[52] U.S. Cl. ..... 29/426.5; 29/447; 29/413; 29/414

[58] Field of Search ..... 29/426.5, 34 B, 29/447, 243.53, 413, 414; 219/121.11, 603, 600, 607, 610, 616, 617; 228/144.1, 144

*Primary Examiner*—David P. Bryant
*Assistant Examiner*—Marc W. Butler
*Attorney, Agent, or Firm*—Edward D. Murphy

[57] ABSTRACT

The invention relates to a method of removing punch rivets, which are set into a workpiece and have a male die end for driving the punch rivet and an opposite female die end which penetrates the workpiece. A pin is placed with its front end onto the male die end so as substantially to cover the latter and, with a simultaneous supply of energy through the pin, heats the contact area between pin and male die end up to a fusion temperature in the contact area, whereupon after cooling of the contact area the pin is retracted counter to the pressure of an abutment supported on the workpiece and carries along the punch rivet which is thereby withdrawn from the workpiece.

12 Claims, 4 Drawing Sheets

METHOD OF REMOVING PUNCH RIVETS SET INTO A WORKPIECE

Figure 1A:
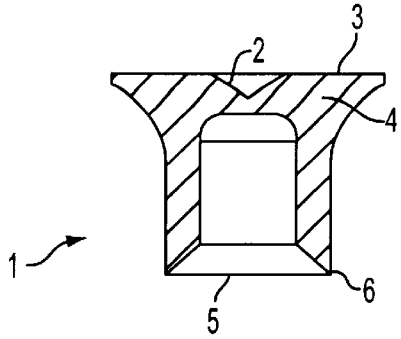

The present invention relates to a method of removing a punch rivet, which is set into a workpiece and has a male die end by which the punch rivet is driven and an opposite female die end. The invention further relates to a device for carrying out this method.

A punch rivet for use in the method according to the invention is described and illustrated in DE OS 43 33 052 and has a flat, plate-like head at its male die end. During the riveting process the edge of the head, upon which the tool for driving in the punch rivet presses, is pressed into the relevant workpiece while the female die end provided with a cutting edge pierces the workpiece, the cutting edge spreading radially outwards upon penetration of the female die end into the workpiece, so that the riveted joint is complete.

Furthermore, in German patent application 197 01 780.0 a punch rivet has been proposed which is provided in an axially symmetric design with cutting edges at both ends. During the riveting process, as with the previously described punch rivet, the female die end pierces the workpiece with its cutting edge, while the male die end is deformed radially outwards so that the riveted joint is produced at this side of the punch rivet.

Further forms of punch rivet are moreover known, for example punch rivets according to DE PS 39 42 482 with a curved head at the male die end.

Producing riveted joints with such punch rivets results in essentially permanent connection of, for example, two metal sheets, which are to be riveted together and in the context of the present description form the workpiece, into which the punch rivet is set. In order, for example in the case of essential repair work, to detach the riveted parts from one another, the riveted joint has to be undone, this usually being effected by a chisel-like tool or the like which is driven between the metal sheets so that a rivet connecting the metal sheets is torn forcibly out of its seat. The result is not only destruction of the rivet but also deformation of the workpiece, i.e. in particular of the two sheet-metal plates, at the point where the rivet is torn out, which is undesirable and makes it necessary to remachine the relevant parts when re-use of at least one component is required. Apart from this, this method of undoing the riveted joint is a costly and uncontrollable operation which is also rendered more difficult by the fact that riveted joints are often situated in inaccessible places.

It is an object of the invention to facilitate the removal of punch rivets set into a workpiece and in particular substantially to avoid deformation of the workpiece which impairs said workpiece.

The invention provides a method of removing a punch rivet, which is set into a workpiece and has a male die end for driving the punch rivet and an opposite female die end which penetrates into the workpiece, characterised in that a pin is placed with its front end onto the male die end so as substantially to cover the latter and, with a simultaneous supply of energy through the pin, heats the contact area between pin and male die end up to a fusion temperature in the contact area, whereupon after cooling of the contact area the pin is retracted counter to the pressure of an abutment supported on the workpiece and carries along the punch rivet which is thereby withdrawn from the workpiece.

Owing to the fusion of the relevant materials in the contact area between pin and male die end, a particularly strong connection is created, the supply of energy needed for fusion being effected through the pin itself so that separate energy sources acting from outside upon the contact area are not required. Because of the secure, and therefore loadable, connection of pin and male die end it is possible, by retracting the pin, to pull the punch rivet attached to the pin out of its riveted connection to the workpiece, the support provided by the abutment preventing the workpiece from being deformed over a wider area by the tensile forces which arise. The unavoidable deformation caused in the immediate area around the riveted joint by tearing the rivet out of its riveted joint is restricted by the abutment to the area of the riveted joint, the abutment preventing a wider effect upon the workpiece.

The energy supply is preferably effected by current conduction through the pin. The current conduction may be used to effect an arc weld or a resistance weld in the contact area between pin and male die end. In the case of the arc weld, the pin, in the usual manner when arc welding studs, is pressed against the male die end, moved away from the latter to strike an arc and then moved back onto the contact area, where the arc produces a molten mass, into which the pin then dips so that the materials of the pin and the male die end of the punch rivet fuse together. It is also possible to use the energy supply to effect a resistance weld in the contact area between pin and male die end. In this case, the unavoidable electrical resistance in the contact area is utilised to heat the point with a strong current to such an extent that, ultimately, the contact area is heated up to the fusion temperature. After cooling of the pin thus connected by the molten mass to the male die end, there is then a strong, loadable connection, through which sufficient tensile forces may be transmitted from the pin to the punch rivet to detach the latter from the workpiece.

A further possibility of producing heat in the contact area between pin and male die end is to heat the pin by induction heating, the pin again effecting the energy supply to the contact area between pin and male die end. Induction heating is advantageously effected by means of a coil, which surrounds the pin and is supplied with a suitable alternating current. Such induction heating makes it possible to produce a soldered joint in the contact area, it being naturally necessary to supply the solder for the purpose to the contact area either prior to mounting of the pin or afterwards from the side.

A further possibility of supplying energy through the pin is to press the pin in rotation while pressing onto the male die end in such a way as to produce a friction weld in the contact area.

Because workpieces riveted in the sense of the above description are often provided with a protective layer of lacquer or the like and, after extended use, dirt may have accumulated, it is advantageous to clean the male die end prior to supplying energy through the pin.

This is advantageously effected by rotating the pin while pressing its front end against the male die end, the resultant friction, particularly in the case of not too extreme fouling, exposing the material of the punch rivet at the male die end and subsequently allowing, for example, an arc weld or a resistance weld to be effected without any problem. In the case of particular fouling or particularly resistant lacquering, it is of course also possible to use for cleaning a special-purpose rotating shaver, for example a suitably surface-ground end of a drill.

A device for carrying out the method using arc welding advantageously comprises a stud welding gun, which holds the pin as an electrode and with its motion drive moves the pin axially back and forth while supplying power. It is possible to use as the device a standard stud welding gun such as is disclosed, for example, in GB PS 636 343.

To carry out the method incorporating friction welding, a device comprising a rotary tool, which holds and rotates the pin while pressing it against the male die end is advantageously used. The tool is therefore one which is similar to a drilling machine, into which the pin is clamped and which presses with the pin against the male die end so that the pin rotates with its front end on the male die end and sufficient heat is supplied through the pin to ultimately produce a rotary friction weld.

When the punch rivets are of the type which have a flat, plate-like head, the head is advantageously designed in such a way that it is provided with a central recess for receiving a correspondingly shaped projection at the front end of the pin so that the pin may be mounted centrally onto the male die end. This design automatically centres the pin relative to the punch rivet so that the defined position of the pin relative to the male die end required for the welding process is guaranteed. This facilitates handling of the relevant device for effecting the method according to the invention, especially when friction welding is involved.

The method according to the invention may be used to particular advantage when the parts connected by punch rivets are car body parts which, for example following an accident, are in need of repair, in which case individual body parts frequently have to be exchanged. To enable such an exchange despite the, in principle, permanent connection by means of the punch rivets, it is possible to use the method described above which enables riveted joints used for fastening the relevant body parts together to be detached from one another easily and without wider damage to said body parts, after which the still usable body part remaining on the car is subsequently provided with a new body part to replace the damaged one. The remaining body part is still quite capable of being joined to the new body part because it has not been significantly damaged by the previously described separation process. It is of course necessary for the connection between said two body parts to be effected by a different method, for example by riveting using larger rivets, especially blind rivets, or by a bolted connection.

Figure 1B:
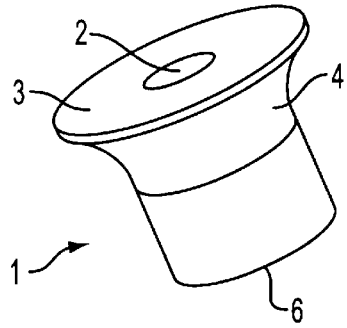

Preferred embodiments of a method for removing punch rivets will now be described with reference to the accompanying drawings, in which:

FIG. 1*a* shows a punch rivet with a plate-like head in section;

FIG. 1*b* is a perspective view of the punch rivet of FIG. 1*a;*

Figure 2A:
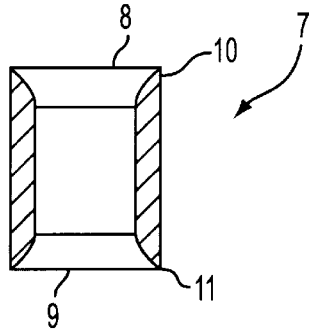
Figure 2B:
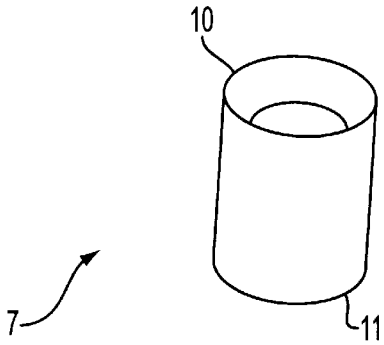

FIG. 2*a* shows an axially symmetric punch rivet in section;

FIG. 2*b* is a perspective view of the punch rivet of FIG. 2*a;*

Figure 3A:
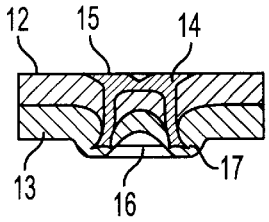
Figure 3B:
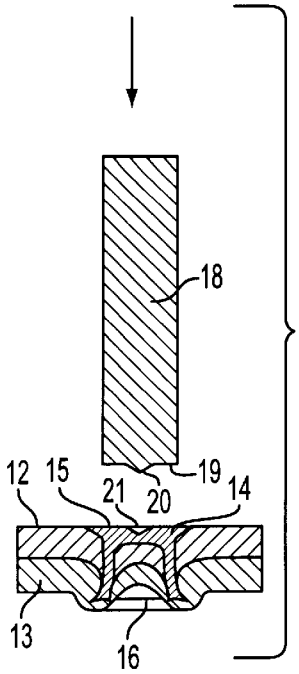
Figure 3C:
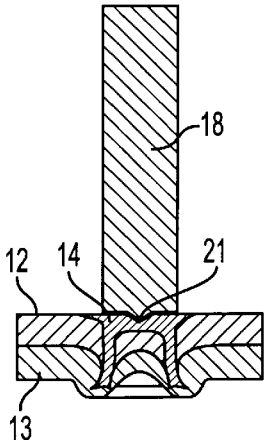
Figure 3D:
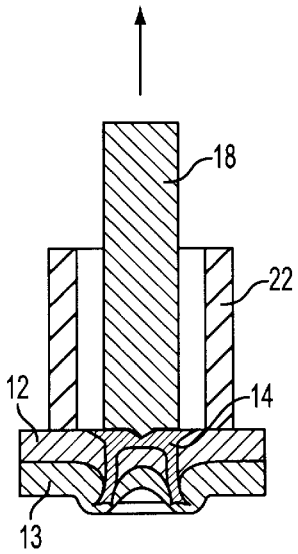
Figure 3E:
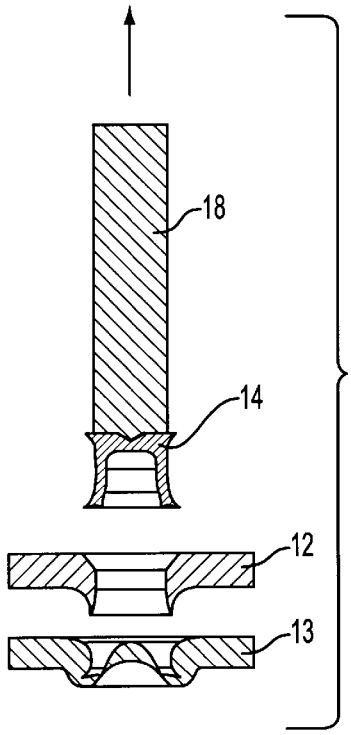
Figure 4A:
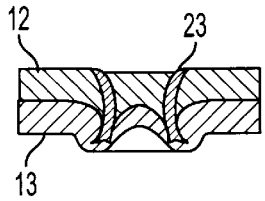

FIG. 3*a* shows a riveted joint of two metal sheets with a punch rivet according to FIG. 1;

FIG. 3*b* shows the riveted joint of FIG. 3*a* with an approaching pin;

FIG. 3*c* shows the riveted joint of FIG. 3*a* with a welded-on pin;

FIG. 3*d* shows the riveted joint of FIG. 3*a* with a welded-on pin and an abutment;

FIG. 3*e* shows the separated riveted joint with the punch rivet withdrawn by means of the pin;

FIG. 4*a* shows a riveted joint of two metal sheets with a punch rivet according to FIG. 2*a;*

Figure 4B:
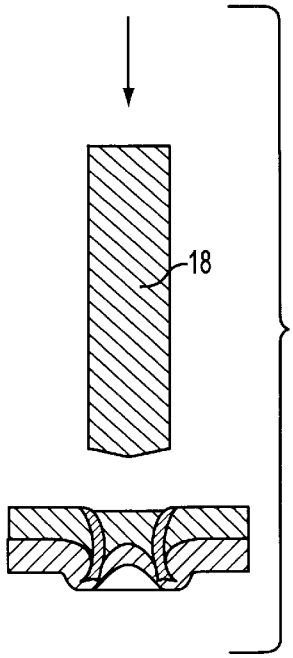
Figure 4C:
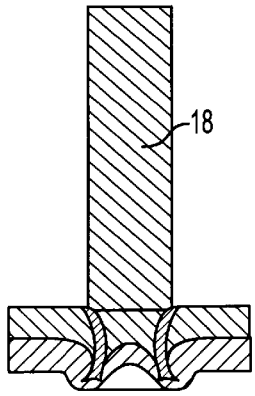
Figure 4D:
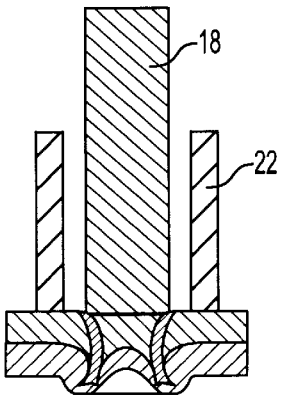
Figure 4E:
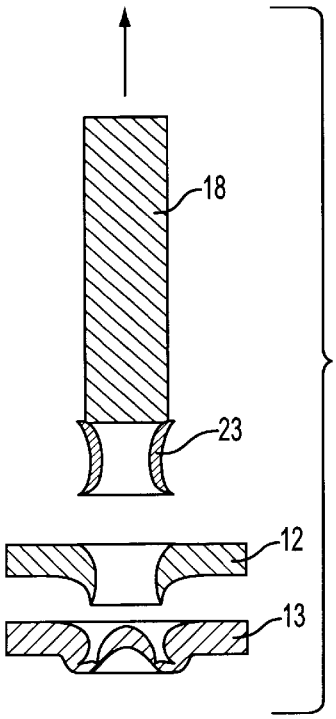
Figure 5:
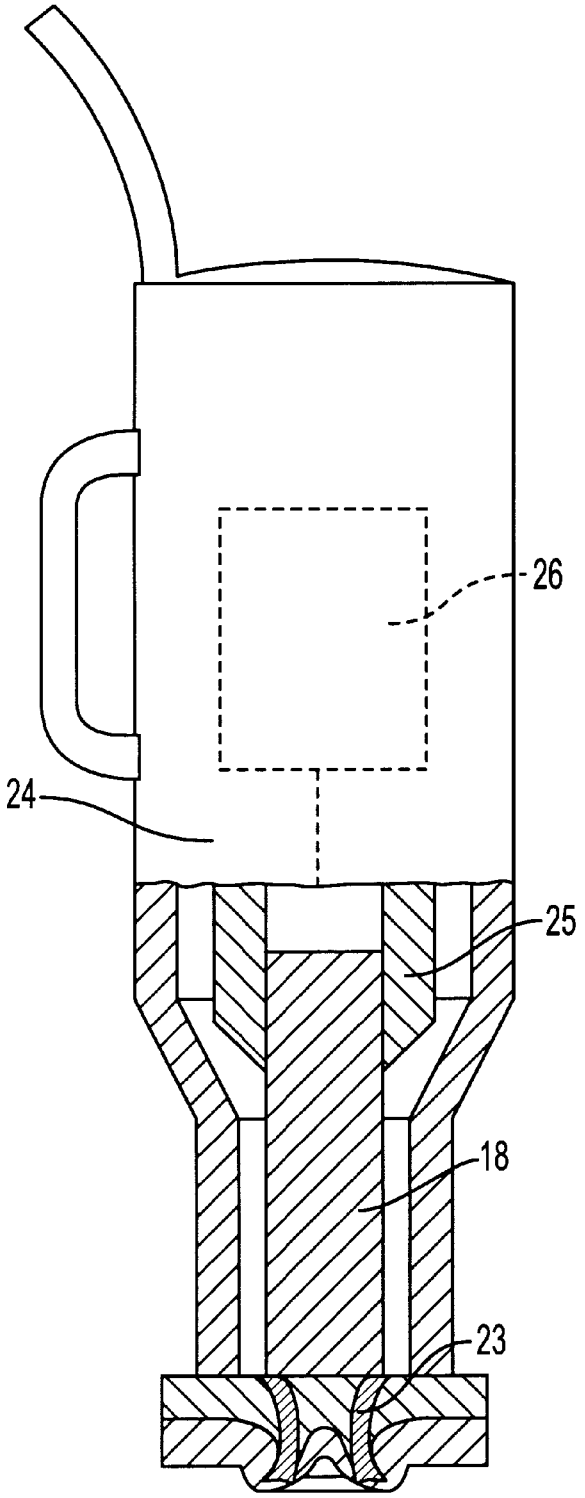

FIG. 4*b* shows the riveted joint of FIG. 4*a* with an approaching pin;

FIG. 4*c* shows the riveted joint of FIG. 4*a* with a welded-on pin;

FIG. 4*d* shows the riveted joint of FIG. 4*a* with a welded-on pin and an abutment;

FIG. 4*e* shows the separated riveted joint and the punch rivet withdrawn by means of the pin, and FIG. 5 shows the riveted joint according to FIG. 4*d* with the stud welding gun holding the pin.

FIG. 1*a* shows a rivet 1 of a design such as is disclosed in DE OS 43 33 052 but with an additional central recess 2. The punch rivet 1 has at its one end, namely the male die end 3, the plate-like head 4. The opposite end is formed by the female die end 5 having the cutting edge 6. The recess 2 is used to guide the pin, more details of which are provided further below. FIG. 1*b* shows a perspective view of the punch rivet 1.

FIG. 2*a* shows another form of construction of a punch rivet 7 which is axially symmetric. In FIG. 2*b* the same punch rivet is shown in a perspective view. The punch rivet 7 has at its one end the male die end 8 and at its opposite end the female die end 9. Both the male die end 8 and the female die end 9 are provided with a circumferential cutting edge, 10 and 11 respectively.

FIG. 3 shows the riveted joint of two metal sheets 12 and 13 (which form the workpiece) by means of the punch rivet 14, which is based on the punch rivet 1 according to FIGS. 1*a* and 1*b*. The punch rivet 14 is pressed at its male die end 15 with its plate-like head into the metal sheet 12, while at the female die end 16 the cutting edge 17 is spread radially outwards, thereby creating the riveted joint. Said riveted joint is of a known design.

FIG. 3*b* shows the riveted joint according to FIG. 3*a* being approached by the pin 18. The pin 18 at its front end 19 has the projection 20 which fits into the recess 21 in the male die end 15 (see reference numeral 2 in FIG. 1*a*).

FIG. 3*c* shows the same riveted joint with the pin 18 placed onto the male die end 15, a connection between pin 18 and rivet 14 effected by arc welding being indicated in the drawing by the bold line 21 situated in the contact area between pin 18 and male die end 15. Said weld situated in the contact area 21 between the front end 19 and male die end 15 was effected by moving the pin 18, in the manner customary when welding studs using arc welding, into contact with the punch rivet 14 so as to strike an arc which, by retracting the pin 18 for several milliseconds, was provided with the necessary burning time to cause the front face 19 of the pin 18 and the surface of the male die end 15 of the punch rivet 14 to fuse together. This is then followed in the customary manner by lowering of the pin 18 into the molten mass thus formed and by a subsequent cooling process, with the result that a strong, loadable connection is established between the pin 18 and the punch rivet 14.

FIG. 3*d* shows the start of removal of the punch rivet 14 from the riveted joint during which, after the abutment 22 is placed onto the top metal sheet 12, a pull is exerted on the pin 18 in the direction of the arrow in the drawing with the result that the punch rivet 14 is withdrawn from its riveted joint. During the process, at least in the immediate area of the abutment 22, the metal sheet 12 and the metal sheet 13 underneath are practically unable to deform so that there is only specific residual damage of the two metal sheets 12 and 13 at the seat point of the rivet 14. The remaining region of the two metal sheets 12 and 13 remains unaffected by the process. The strong connection between the pin 18 and the punch rivet 14 produced by the weld prevents the pin 18 from being torn off the punch rivet 14 so that ultimately the punch rivet 14 is withdrawn completely from the riveted joint.

Removal of the punch rivet 14 is illustrated in FIG. 3*e*, which shows the two metal sheets 12 and 13 separated from one another and, at a remove, the withdrawn punch rivet 14 still attached to the pin 18. Thus, the two metal sheets 12 and 13 are disconnected and may then be taken off for further treatment of some kind, in particular recycling, because, apart from the damage caused by the punch rivet 14 at the relevant point, the metal sheets 12 and 13 have not otherwise been altered in any way.

In FIGS. 4*a* to 4*e* the same processes as were illustrated in FIGS. 3*a* to 3*e* are reproduced only, here, they relate to the treatment of a punch rivet according to FIGS. 2*a* and 2*b*. As the processes of placing the pin 18 onto the punch rivet 23, welding the pin 18 and the punch rivet 23 together and removing the punch rivet 23 from the riveted joint are identical to the process steps shown in FIGS. 3*a* to 3*e*, reference may be made to the description of the appropriate FIGS. 3*a* to 3*e*.

To produce the connection between pin 18 and punch rivet 14 or 23 by means of arc welding, a stud welding gun 24 is advantageously used. Such a stud welding gun is described, for example, in GB PS 636 343. The stud welding gun 24 has the chuck 25, which grips the pin 18 and permits execution of the axial movements which are required during arc welding and are effected by a motion mechanism 26, which may be of various types known to the prior art such as that shown in U.S. Pat. No. 5,502,291, the disclosure of which is incorporated herein by reference, and which is housed in the interior of the stud welding gun 24. The pin 18, as already mentioned above, is first moved onto the punch rivet, here the punch rivet 23, to strike the arc and then, after a sufficiently long burning time of the arc, the pin 18 is moved onto the punch rivet 23 to produce the required weld in the contact area between pin 18 and the male die end of the punch rivet 23.

A tool of the type shown in FIG. 5 may alternatively be used to produce a resistance weld, the tool merely having to be equipped with a suitable power supply and a suitable motion control program. Such tools are likewise prior art.

It should also be pointed out that a tool as shown in FIG. 5 may also be used for friction welding. In said case, the motion mechanism 26 is a known type of rotary drive which sets the pin 18 held by the chuck 25 in rotation and presses said pin against the punch rivet 23 until sufficient heat is generated in the relevant contact area to produce a weld.

What is claimed is:

1. A method of removing a punch rivet (4, 14, 23), which is set into a workpiece (12, 13) and has a male die end (15) for driving the punch rivet (7, 14) and an opposite female die end (16) which penetrates into the workpiece (12, 13), characterized in that a pin (18) is placed with its front end (19) onto the male die end (15) so as substantially to cover the latter and, with a simultaneous supply of energy through the pin (18), heats the contact area between the pin (18) and male die (15) up to a fusion temperature in the contact area, cooling the contact area, applying pressure to the workpiece (12, 13) by an abutment (22) supported on the workpiece (12, 13), retracting the pin (18) and the punch rivet (4, 14, 23) fused therewith from the workpiece (12, 13) counter to the applying of pressure to the workpiece (12, 13), whereby the punch rivet (4, 14, 23) is withdrawn from the workpiece (12, 13).

2. A method according to claim 1, characterised in that the energy is supplied by current conduction through the pin (18) and fusion is produced by arc welding.

3. A method according to claim 1, characterised in that the energy is supplied by current conduction through the pin (18) and fusion is produced by resistance welding.

4. A method according to claim 1, characterised in that heating is effected by induction heating of the pin (18) with soldering of the contact area.

5. A method according to claim 1, characterised in that the energy is supplied by rotation of the pin (18) and simultaneous pressure upon the male die end (15) to produce friction welding of the contact area.

6. A method according to one of claims 1 to 5, characterised in that the male die end (15) is cleaned prior to the supply of energy through the pin (18).

7. A method according to claim 6, characterised in that cleaning is effected by rotation of the pin (18) while pressing its front end (19) against the male die end (15).

8. A method according to claim 6, characterised in that cleaning is effected with a rotary shaver.

9. A method according to claim 2, characterised in that, for arc welding, the pin (18) is moved away from and then back towards the male die end (15).

10. A device for carrying out the method according to claim 2, comprising a stud welding gun (24), said gun including a chuck for holding said pin and for supplying current thereto and a motor for moving said pin axially back and forth while simultaneously supplying power.

11. A device for carrying out the method according to claim 5, comprising a rotary tool (24), said tool including a chuck for holding and rotating the pin (18) while pressing the pin against the male die end (15).

12. A punch rivet (14) with a plate-like head for carrying out the method according to claim 1, characterised in that the head is provided with a central recess (26) for receiving a correspondingly shaped projection (20) at the front end (19) of the pin (18) upon placing of the pin onto the male die end (15).

* * * * *